US007963222B2

(12) United States Patent
Esparch Marti et al.

(10) Patent No.: US 7,963,222 B2
(45) Date of Patent: Jun. 21, 2011

(54) FLEXOGRAPHIC PRINTING MACHINE

(75) Inventors: Lluis Esparch Marti, Riudellots de la Selva (ES); Jordi Puig Vila, Riudellots de la Selva (ES); Lluis Castello Plaja, Riudellots de la Selva (ES)

(73) Assignee: Comexi, S.A., Girona (ES)

( * ) Notice: Subject to any disclaimer, the term of this patent is extended or adjusted under 35 U.S.C. 154(b) by 509 days.

(21) Appl. No.: 12/092,183

(22) PCT Filed: Sep. 29, 2006

(86) PCT No.: PCT/ES2006/000546

§ 371 (c)(1), (2), (4) Date: Sep. 12, 2008

(87) PCT Pub. No.: WO2007/051876

PCT Pub. Date: May 10, 2007

(65) Prior Publication Data

US 2009/0071353 A1 Mar. 19, 2009

(30) Foreign Application Priority Data

Oct. 31, 2005 (ES) ..... 200502640

(51) Int. Cl.

| | |
|---|---|
| ***B41F 5/24*** | (2006.01) |
| ***B41F 3/56*** | (2006.01) |
| ***B41F 31/32*** | (2006.01) |
| ***B41F 31/30*** | (2006.01) |
| ***B41F 13/24*** | (2006.01) |
| ***B41F 13/34*** | (2006.01) |

(52) U.S. Cl. ..... 101/351.1; 101/182; 101/218; 101/247; 101/352.02

(58) Field of Classification Search ..... 101/182, 101/184, 185, 217, 351.1, 352.01, 352.02
See application file for complete search history.

(56) References Cited

U.S. PATENT DOCUMENTS

| | | | | |
|---|---|---|---|---|
| 5,341,739 | A | 8/1994 | Rogge et al. | |
| 5,471,929 | A * | 12/1995 | Rogge et al. | 101/247 |
| 5,974,968 | A * | 11/1999 | Achelpohl et al. | 101/247 |
| 6,125,752 | A * | 10/2000 | Freddo et al. | 101/182 |

(Continued)

FOREIGN PATENT DOCUMENTS

| | | |
|---|---|---|
| EP | 1080888 | 3/2001 |

(Continued)

OTHER PUBLICATIONS

International Search Report for International application No. PCT/ES2006/000546 dated Mar. 26, 2007.

*Primary Examiner* — Daniel J Colilla
*Assistant Examiner* — Leo T Hinze
(74) *Attorney, Agent, or Firm* — RatnerPrestia

(57) ABSTRACT

A flexographic printing machine including at least one printing unit with an ink roller mounted at one end to a first sliding support and a plate-holding roller mounted at one end to a second sliding support, and at least one guide member for guiding the movements of the supports in directions parallel to an imaginary line which perpendicularly intersects the axes of the ink and plate-holding rollers. In addition, first upper and lower screws are provided parallel to said line above and below the axes of the ink and plate-holding rollers in order to move the first support, and second upper and lower screws are provided parallel to the line above and below the axes of the ink and plate-holding rollers in order to move the second support.

15 Claims, 5 Drawing Sheets

U.S. PATENT DOCUMENTS

| | | | | |
|---|---|---|---|---|
| 6,142,073 | A * | 11/2000 | Zeman et al. | 101/216 |
| 6,176,181 | B1 * | 1/2001 | Van Ryzin et al. | 101/216 |
| 6,615,716 | B1 * | 9/2003 | Freddo et al. | 101/216 |
| 6,789,477 | B2 * | 9/2004 | Rogge et al. | 101/248 |
| 7,258,066 | B2 * | 8/2007 | Koopmann | 101/247 |
| 2005/0257704 | A1 * | 11/2005 | Pas et al. | 101/216 |

FOREIGN PATENT DOCUMENTS

| | | |
|---|---|---|
| EP | 1080890 | 3/2001 |
| ES | 2074008 | 8/1995 |
| ES | 2112110 | 3/1998 |
| ES | 2127050 | 4/1999 |

* cited by examiner

FLEXOGRAPHIC PRINTING MACHINE

This application is a U.S. National Phase of PCT Application No. PCT/ES2006/000546, filed Sep. 29, 2006.

TECHNICAL FIELD

The present invention generally relates to a flexographic printing machine and more particularly to a flexographic printing machine provided with a printing drum and at least one printing unit with an ink roller and a plate-holding roller mounted such that in a work position the former is in contact with the latter, and the latter is in contact with the printing drum, and in a rest position they are separated such that respective sleeves can be inserted and removed.

STATE OF PRIOR ART

A type of printing machine, for example for flexographic printing, is known comprising a framing provided with two side frames between which a central printing drum is rotatably mounted over which a web of material to be printed passes, and one or more printing units located next to said printing drum for printing respective colors on the web of material to be printed. Each printing unit includes an ink roller and a plate-holding roller mounted on respective sliding supports arranged to be linearly moved along one or more guide members between a rest position and a work position by actuating means. The ink roller and the plate-holding roller comprise respective cores on which corresponding removable sleeves are arranged. In the mentioned rest position the ink roller and the plate-holding roller are mutually separated and the plate-holding roller is separated from the printing drum such that it is possible to place or remove the ink and plate-holding rollers or insert and remove their sleeves. In the work position an ink unit is in contact with the ink roller in order to apply ink to the anilox or screen sleeve of the ink roller, the ink roller is in contact with the plate-holding roller in order to transfer the ink to a plate mounted on the sleeve of the plate-holding roller, and the plate-holding roller is in contact with the material to be printed supported by the printing drum in order to print the engraving of the plate on the material to be printed.

Patent ES-A-2127050 describes a printing machine of this type in which the movement of each sliding support is guided by a guide rail parallel to an imaginary line which perpendicularly intersects the axes of the ink and plate-holding rollers, the rails being located below the axes of the ink and plate-holding rollers. Each sliding support has joined thereto a nut coupled to a corresponding screw parallel to said imaginary line and located between the guide rail and the imaginary line, and each screw is actuated by a motor mounted on the frame. Here, the sliding supports have bearings on two pivoting parts and the ink and plate-holding rollers are removed and placed in the radial direction.

Patent EP-A-1080888 describes a printing machine of this type which, for guiding the movements of the mentioned sliding supports, comprises two guide rails supported on the side frame above and below the ink and plate-holding rollers respectively, in directions parallel to an imaginary line which perpendicularly intersects the axes of the ink and plate-holding rollers. Each sliding support is coupled to both rails by means of corresponding runners. The device comprises a pair of screws aligned with one another and with said imaginary line, connected to each of the sliding supports and coupled to respective nuts fixed to the framing. Actuating means are arranged to make the two screws rotate independently. With this construction the screws move together with the respective sliding supports for the purpose of clearing an opening of the side frame through which the sleeves are axially inserted or removed when the ink and plate-holding rollers are in the rest position. This has the drawback of requiring an increase in the size of the framing in order to provide enough space for the movements of the screws. Furthermore it has the drawback that the motors and transmissions for actuating the screws must be mounted in the respective sliding supports in order to move together with the same and with the screws, which involves a relatively complex construction.

DISCLOSURE OF THE INVENTION

The present invention contributes to overcoming the previous and other drawbacks by providing a printing machine comprising a printing drum rotatably mounted on a framing comprising two side frames, and adapted to support a web of material to be printed, and at least one printing unit comprising an ink roller and a plate-holding roller adjacent to said printing drum. On at least one of said side frames the printing machine comprises a first sliding support on which the ink roller is mounted and a second sliding support on which the plate-holding roller is mounted, at least one linear guide member supported on the side frame for guiding movements of said first and second sliding supports in directions that are parallel to an imaginary line which perpendicularly intersects the axes of the ink and plate-holding rollers; and actuating means configured and arranged for moving the first and second sliding supports between rest positions, in which sleeves can be axially inserted or removed from the ink and plate-holding rollers respectively, and work positions, in which the plate-holding roller is in contact with said web of material to be printed supported by the printing drum and the ink roller is in contact with the plate-holding roller. The printing machine of the present invention is characterized in that said actuating means comprise first upper and lower worm screws arranged parallel to said imaginary line above and below the axes of the ink and plate-holding rollers respectively, respective first nuts joined to the first sliding support and coupled to said first upper and lower worm screws, and first actuating means for actuating the first upper and lower worm screws in unison, and second upper and lower worm screws arranged parallel to said imaginary line above and below the axes of the ink and plate-holding rollers respectively, respective second nuts joined to the second sliding support and coupled to said second upper and lower worm screws, and second actuating means for actuating the second upper and lower worm screws in unison.

The mentioned first and second upper worm screws are separated from the first and second lower worm screws respectively, by sufficient distances in order to allow the passage therebetween of said sleeves of the ink and plate-holding rollers respectively, in their axial directions, through at least one opening formed in the side frame. The printing machine can incorporate two guide rails, one upper and another lower guide rail, for guiding the movements of the sliding supports. In this case the upper rail is separated from the lower rail by a distance that is also sufficient in order to allow the passage between both of the sleeves of the ink and plate-holding rollers in their axial directions.

With this construction the screws are in fixed positions and do not move together with the sliding supports, therefore the framing only requires the exact space in order to accommodate the screws in their fixed positions. The drive motors of the screws and their transmissions can be mounted in a stationary manner on the framing, which allows a relatively simple construction.

BRIEF DESCRIPTION OF THE DRAWINGS

The previous and other advantages and features will be more fully understood from the following detailed description of several embodiments with reference to the attached drawings in which.

DETAILED DESCRIPTION OF AN EXEMPLARY EMBODIMENT

Figure 1:
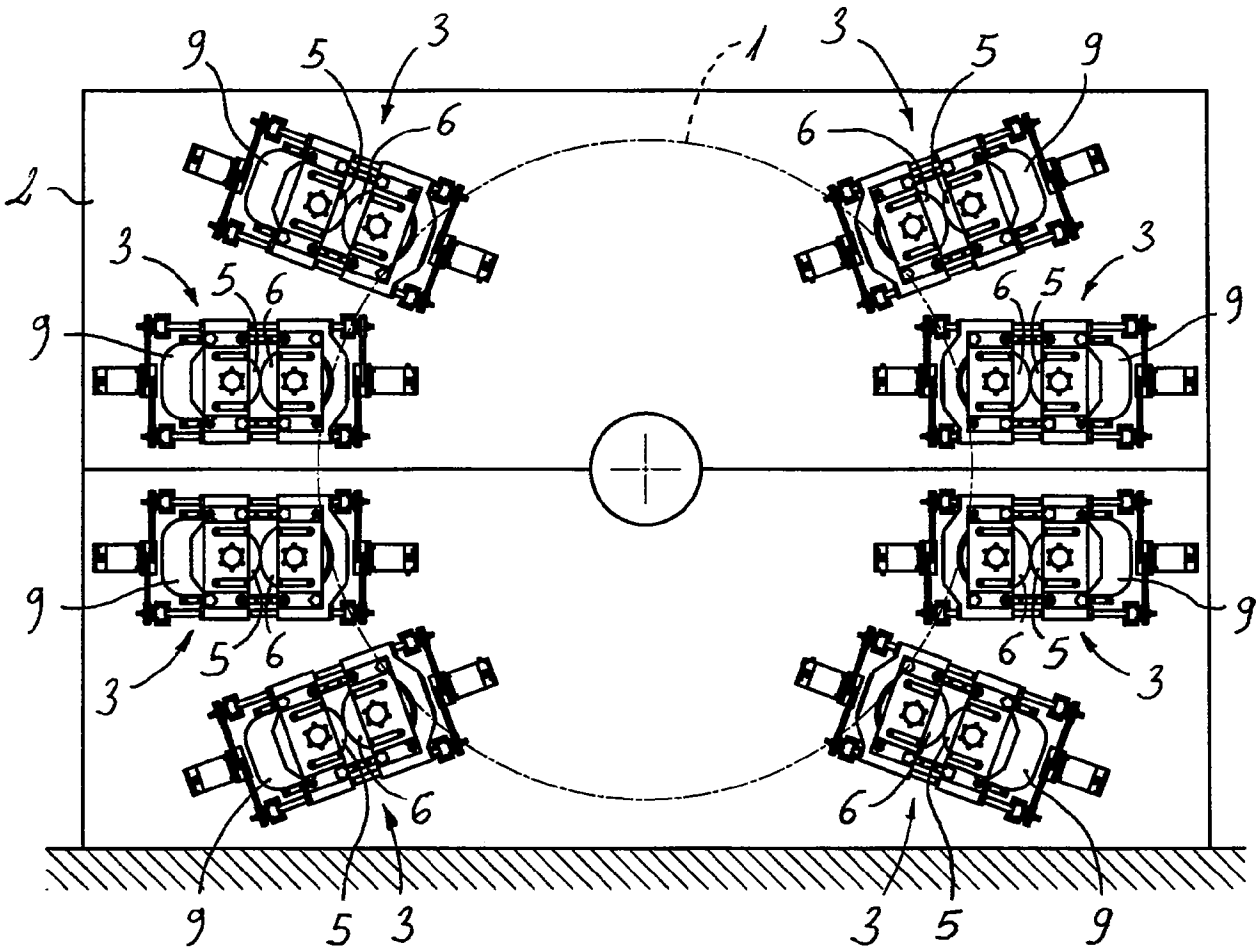
FIG. 1 is a schematic side view of a printing machine according to a first embodiment of the present invention.

With reference first to FIG. 1, the printing machine of the present invention is, for example, a flexographic printing machine comprising a central printing drum 1 rotatably mounted on a framing comprising two side frames 2, of which only one is visible in FIG. 1. Each side frame 2 is generally made in two parts, with a horizontal partition at the height of the axis of the printing drum 1. The mentioned printing drum 1 is adapted to dynamically support a web of material to be printed (not shown). At each side of the printing drum 1, there are arranged four printing units 3, each of which is adapted to print a color on the web of material to be printed. It must be pointed out that the number and the position of the printing units is not relevant for the purposes of the present invention, it being possible that the printing machine includes only one printing unit or any other number, or includes several printing units, each provided with its own printing drum instead of a single common central printing drum.

Figure 2:
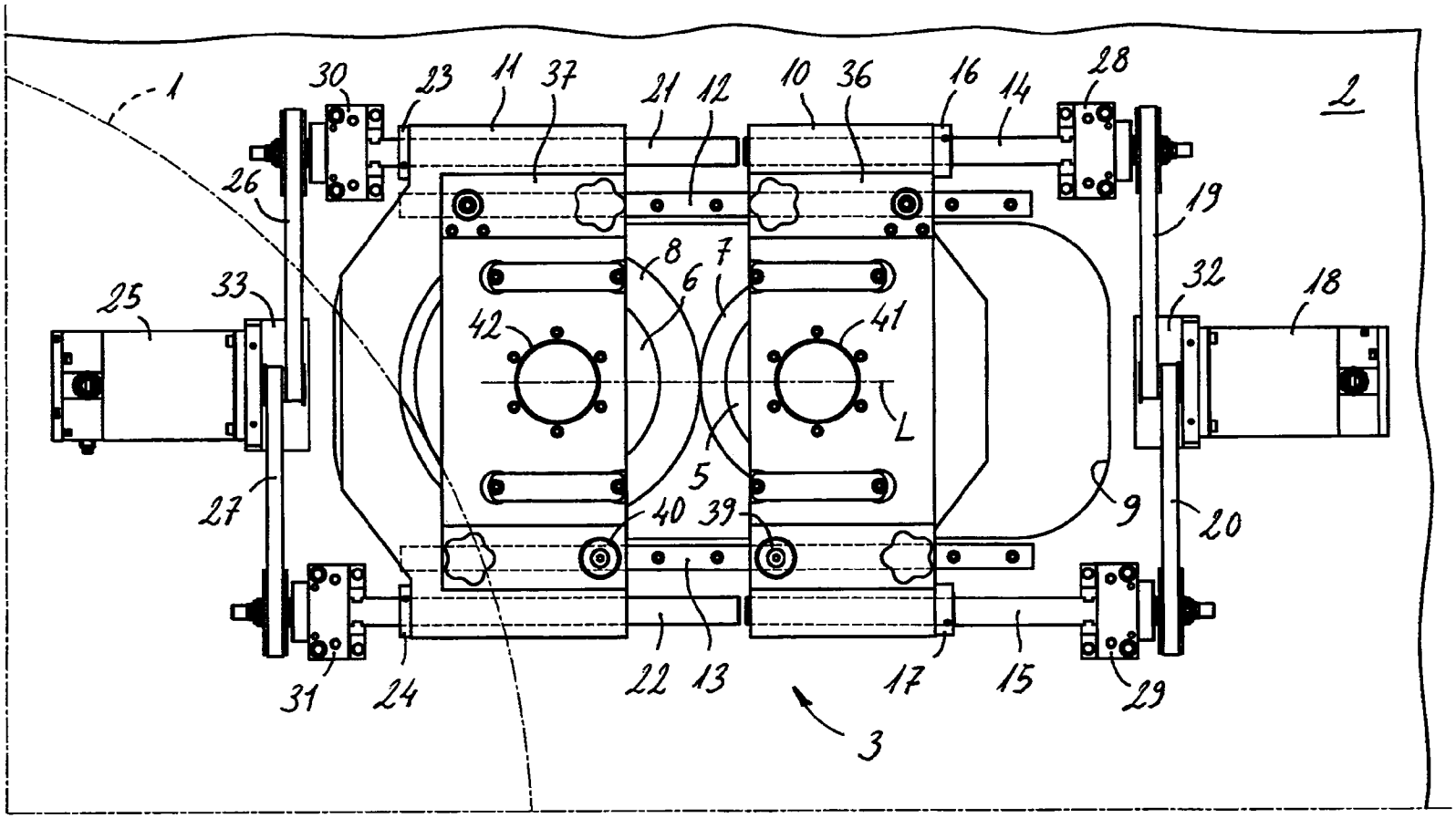
FIG. 2 is a side view of a printing unit of the printing machine of FIG. 1 with the sliding supports in a work position.
Figure 3:
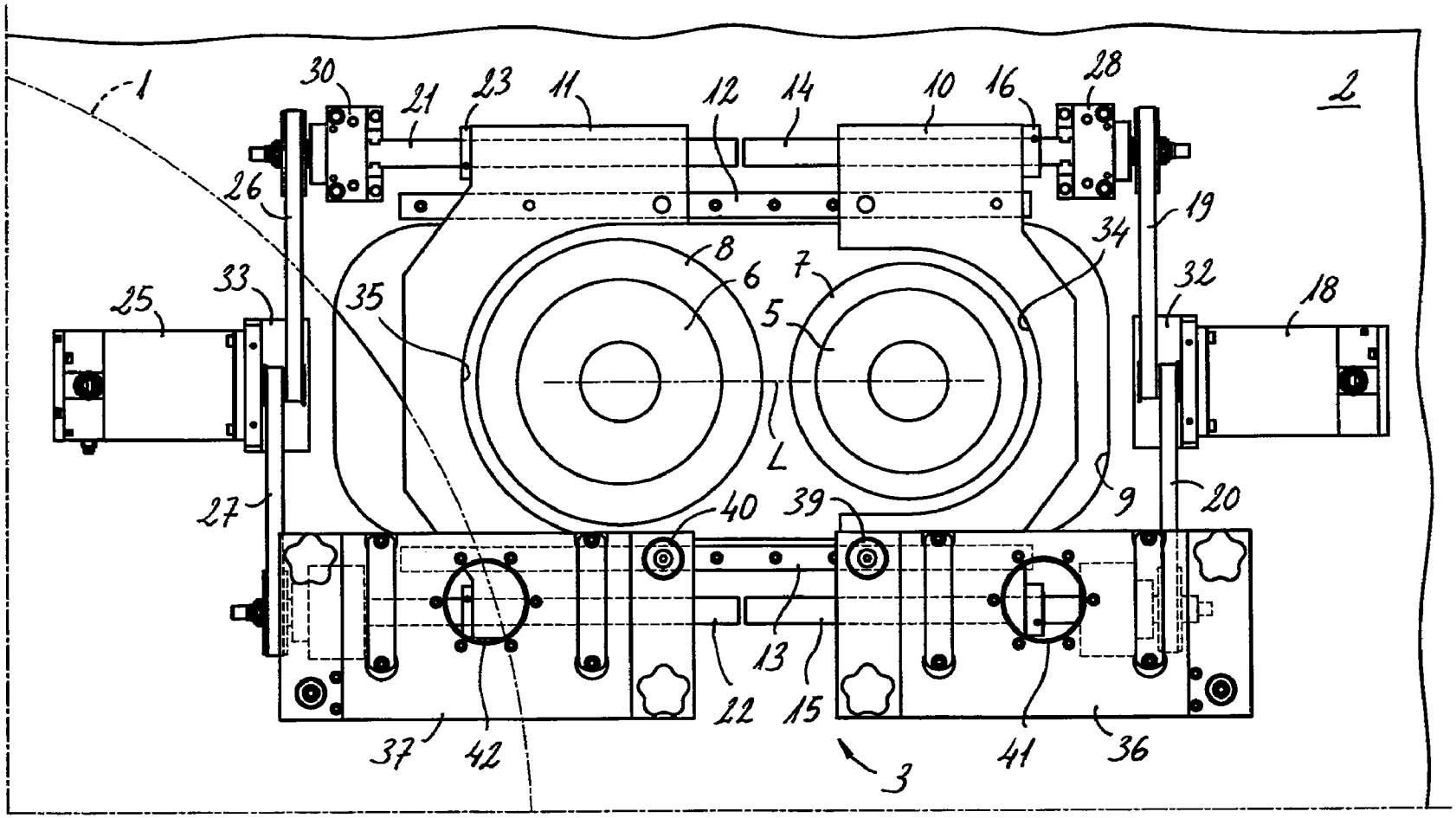
FIG. 3 is a side view of the printing unit of FIG. 2 with the sliding supports in a rest position.

As better shown in FIGS. 2 and 3, each printing unit 3 comprises a plate-holding roller 6 adjacent to said printing drum 1 and an ink roller 5 adjacent to said plate-holding roller 6. The axes of the ink and plate-holding rollers 5, 6 are parallel to the axis of the central printing drum 1. The plate-holding roller 6 is made up of a core on which a removable sleeve 8 holding the plate with the motif to be printed is inserted and the ink roller 5 is made up of a core on which a removable screen sleeve 7, also called anilox, is inserted. Both the ink and plate-holding rollers 5, 6 are mounted at their ends on mobile support devices installed on both side frames 2, such that they can be moved between work positions (FIG. 2), in which the plate-holding roller 6 is in contact with said web of material to be printed supported by the printing drum 1 and the ink roller 5 is in contact with the plate-holding roller 6, and rest positions (FIG. 3), in which the ink and plate-holding rollers 5, 6 are separated and the sleeves 7, 8 can be axially inserted or removed from the ink and plate-holding rollers 5, 6 respectively.

On at least one of said side frames 2, each mobile support device comprises a first sliding support 10 on which one end of the axis of the ink roller 5 is mounted and a second sliding support 11 on which the end of the axis of the plate-holding roller 6 is mounted. The mentioned ends of the axes of the ink and plate-holding rollers 5, 6 project through a corresponding opening 9 formed in the side frame 2. On the side frame 2 there are fixed an upper rail 12 and a lower rail 13 parallel to an imaginary line L which perpendicularly intersects the axes of the ink and plate-holding rollers 5, 6, and located above and below the axes of the ink and plate-holding rollers 5, 6 respectively. The first sliding support 10 has fixed thereto first upper and lower runners (not shown) respectively coupled to said upper and lower rails 12, 13, and the second sliding support 11 has fixed thereto second upper and lower runners (not shown) respectively coupled to said upper and lower rails 12, 13.

The printing machine comprises actuating means for independently moving the first and second sliding supports 10, 11 along the upper and lower rails 12, 13. These actuating means comprise a first upper worm screw 14 and a first lower worm screw 15 arranged parallel to the mentioned imaginary line L, above and below the axes of the ink and plate-holding rollers 5, 6 respectively, and a second upper worm screw 21 and a second lower worm screw 22 arranged parallel to said imaginary line L above and below the axes of the ink and plate-holding rollers 5, 6 respectively. The mentioned first upper and lower worm screws 14, 15 are rotatably supported on supports 28, 29 fixed on the side frame 2 and coupled to respective first nuts 16, 17 joined to the first sliding support 10. Said second upper and lower worm screws 21, 22 are similarly rotatably supported on supports 30, 31 fixed on the side frame 2 and coupled to respective second nuts 23, 24 joined to the second sliding support 11.

The actuating means further comprise first and second electric motors 18, 25 mounted on respective supports 32, 33 fixed on the side frame 2. The mentioned first electric motor 18 is connected to the first upper and lower worm screws 14, 15 by transmission means such as belts 19, 20 mounted on respective pulleys. The mentioned second electric motor 25 is similarly connected to the second upper and lower worm screws 21, 22 by transmission means comprising for example, belts 26, 27 mounted on respective pulleys. Thus, an actuation of the first electric motor 18 makes the first upper and lower worm screws 14, 15 rotate in unison and these screws move the first sliding support 10 along the upper and lower rails 12, 13. Similarly but independently, an actuation of the second electric motor 25 makes the second upper and lower worm screws 21, 22 rotate in unison and these screws move the second sliding support 11 along the upper and lower rails 12, 13.

Each of the sliding supports 10, 11 has a respective bearing-holding plate 36, 37 supporting a bearing 41, 42 coupled to the end of the shaft of the respective ink or plate-holding roller 5, 6. The bearing-holding plates 37, 38 are mounted such that it can axially slide in order to decouple the bearing of the shaft of the roller and pivot with respect to an axis 39, 40 in order to clear the opening 9 formed in the side frame 2 (FIG. 3). The sliding supports 10, 11 have formed respective gaps 34, 35 allowing the passage of the sleeve 7, 8 of the corresponding ink or plate-holding roller 5, 6 when the bearing-holding plates 36, 37 are lowered. The upper and lower rails 12, 13 are generally located as close as possible to upper and lower edges of the opening 9, and the upper rail 12 is obviously separated from the lower rail 13 by a sufficient distance in order to allow the passage between both of the sleeve 7 of the ink roller 5 and the sleeve 8 of the plate-holding roller 6 when they are inserted or removed in their axial directions through said opening 9. The first and second upper worm screws 14, 21 are also separated from the first and second lower worm screws 15, 22 respectively, by sufficient distances in order to allow the passage therebetween of said sleeves 7, 8 in their axial directions.

In the embodiment shown in FIGS. 2 and 3, the first and second upper worm screws 14, 21 are mutually aligned and the first and second lower worm screws 15, 22 are also mutually aligned. The axes of the first upper and lower worm screws 14, 15 and the axes of the second upper and lower worm screws 21, 22 are comprised in an imaginary plane perpendicular to the axes of the ink and plate-holding rollers 5, 6. The first and second upper worm screws 14, 21 are also located further from the imaginary line L than the upper rail 12, and the first and second lower worm screws 15, 22 are located further from the imaginary line L than the lower rail 13. Furthermore, the first upper and lower worm screws 14, 15 are at the same distance from the imaginary line L and the second upper and lower worm screws 21, 22 are also at the same distance from the imaginary line L.

This, however, is not the only construction possible and other geometrical arrangements can be carried out. For example, in an embodiment not shown, the first and second upper worm screws 14, 21 and/or the first and second lower worm screws 15, 22 are located closer to the imaginary line L than the upper rail 12 and/or the lower rail 13 respectively.

Figure 4:
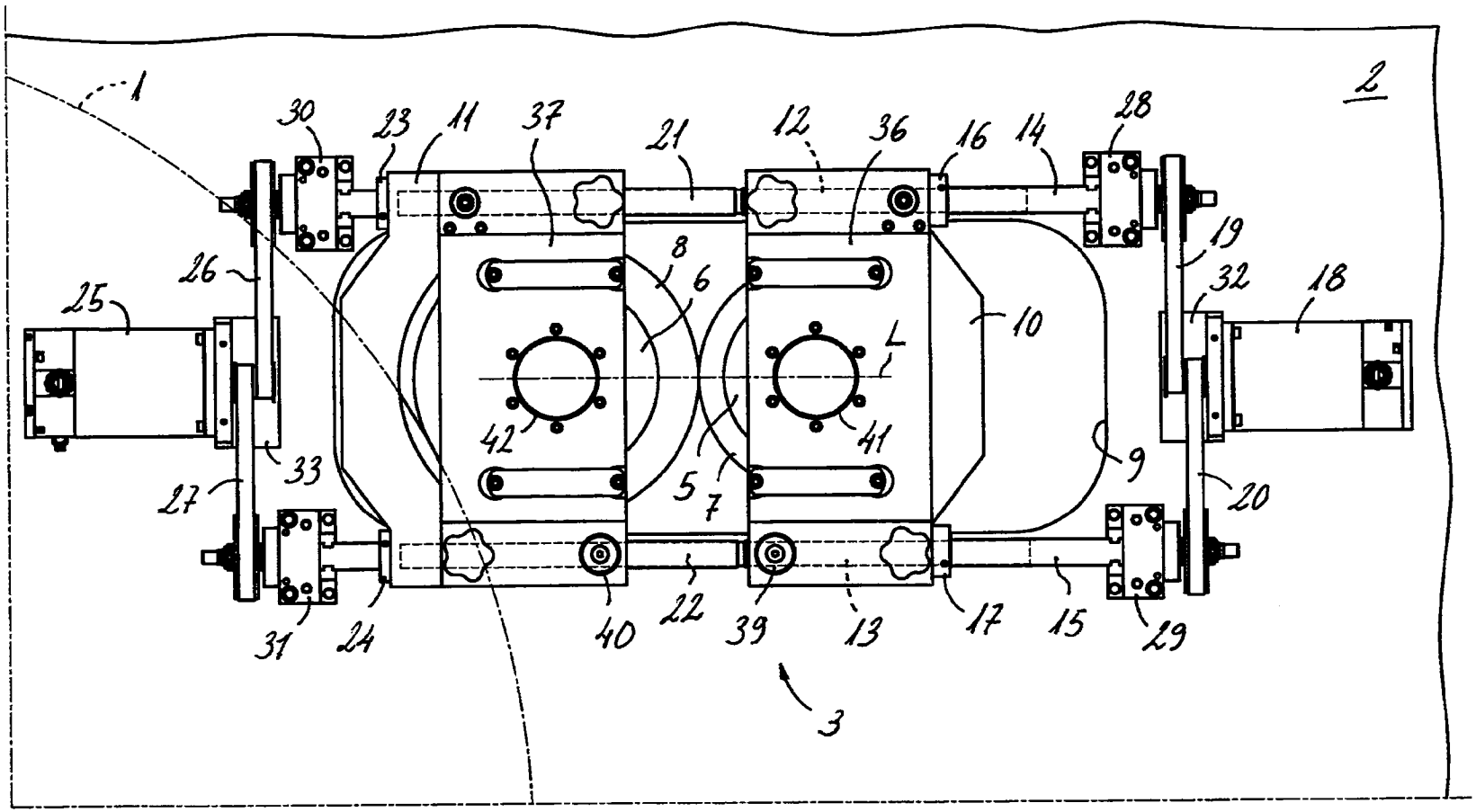
FIG. 4 is a side view of a printing unit according to a second embodiment of the printing machine of the present invention.

FIG. 4 shows another alternative embodiment in which the screws 14, 15, 21, 22 are superimposed on the rails 12, 13 according to a side view. In other words, the axes of the first and second upper worm screws 14, 21 and a central line of the upper rail 12 are comprised in one and the same imaginary plane parallel to the axes of the ink and plate-holding rollers 5, 6, and the axes of the first and second lower worm screws 15, 22 and a central line of the lower rail 13 are comprised in one and the same imaginary plane parallel to the axes of the ink and plate-holding rollers 5, 6. With this construction both the screws 14, 15, 21, 22 and the rails 12, 13 are as close as possible to the imaginary line L.

Figure 5:
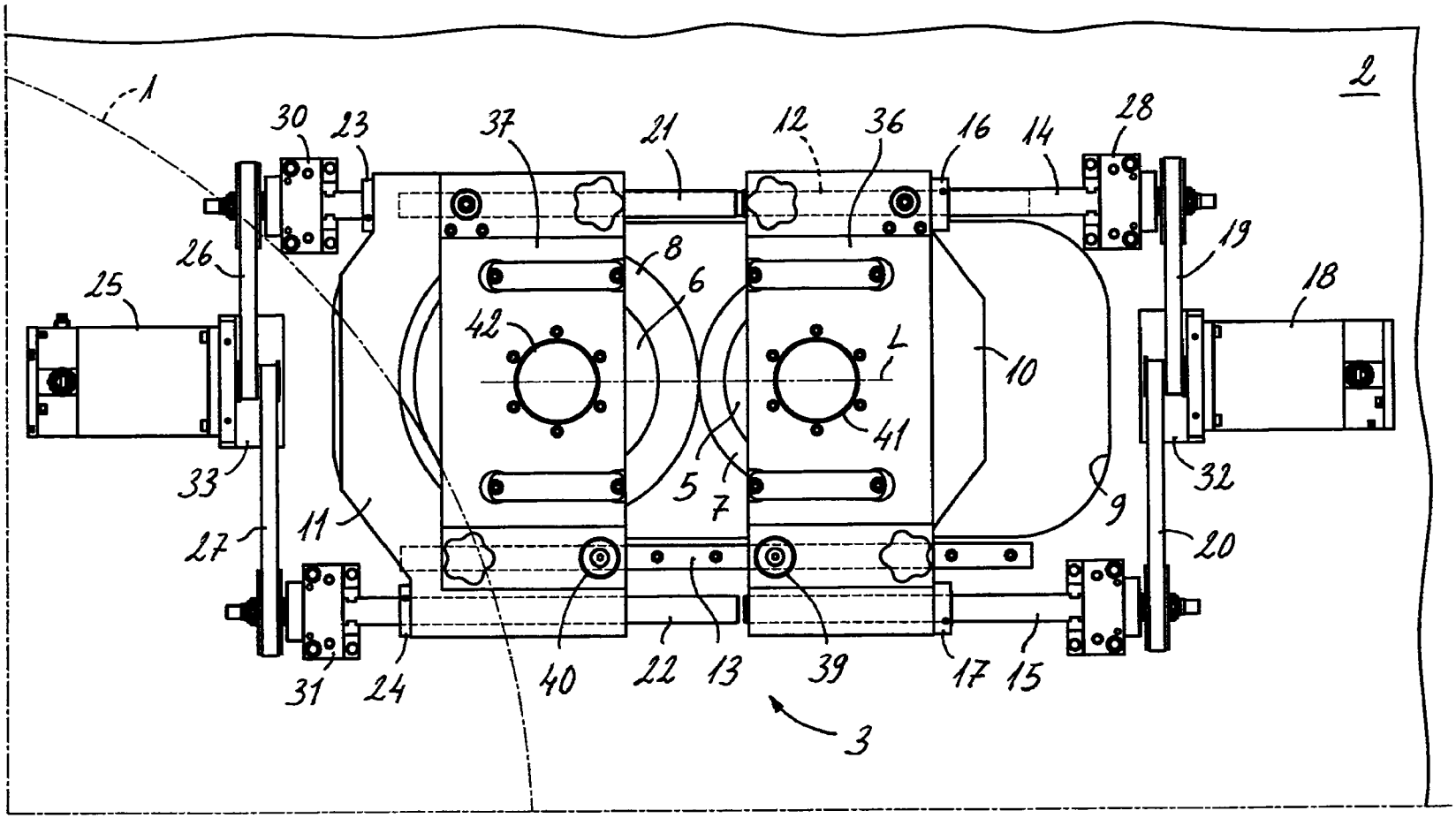
FIG. 5 is a side view of a printing unit according to a third embodiment of the printing machine of the present invention.

Even though in the previous embodiments of FIGS. 2, 3 and 4 there is a symmetry with respect to the imaginary line L, or better said with respect to an imaginary plane comprising the axes of the ink and plate-holding rollers 5, 6, asymmetrical constructions are also possible. For example, FIG. 5 shows yet another embodiment in which the first upper and lower worm screws 14, 15 are at different distances from the imaginary line L and the second upper and lower worm screws 21, 22 are at different distances from the imaginary line L.

It is also not essential for the two screws 14, 21 located at the upper part to be aligned with one another and for the two screws 15, 22 located at the lower part to also be aligned with one another, as has been described in relation to the previous embodiments, but rather both pairs can also be unaligned or one pair can be aligned and the other pair can be unaligned. In fact, in one and the same mobile support device, the arrangement of the first and second upper and lower worm screws 14, 15, 21, 22 associated to the first and second sliding supports 10, 11 in relation to the guide rails 12, 13 can adopt any combination of the arrangements described above in relation to FIGS. 2, 3, 4 and 5.

Likewise, it is also not essential to incorporate a single upper rail 12 and a single lower rail 13 for both sliding supports 10, 11, but rather alternatively, in certain circumstances, each sliding support 10, 11 could be associated to a particular pair of rails, or a single rail for both sliding supports or a single rail for each sliding support could even be used.

The essential feature of the present invention is that each of the sliding supports 10, 11 is guided in a direction parallel to the imaginary line L and is moved by actuating a pair of screws 14, 15 and 21, 22 respectively, the screws of each pair being located on opposite sides of the imaginary line L, and preferably separated enough to allow the passage of the sleeves 7, 8 between both.

It must be pointed out that in the second frame of the framing located on the opposite side of the printing machine (not shown in the figures) each printing group 3 can integrate a mobile support device similar to that described for the first frame 2, although in the second frame the actuation of the sliding supports has no great difficulties given that the sleeves 7, 8 of the ink and plate-holding rollers 5, 6 are not removed through that side and it is not necessary to provide a clear opening to that end. Therefore, in the second frame, other known mobile support devices could be used in combination with the mobile support devices of the present invention installed in the first frame.

A person skilled in the art will be able to introduce variations and modifications in the shown and described embodiments without departing from the scope of the present invention as it is defined in the attached claims.

The invention claimed is:

1. A flexographic printing machine, comprising:

a printing drum rotatably mounted on a framing comprising two side frames and adapted to support a web of material to be printed;

at least one printing unit comprising an ink roller and a plate-holding roller adjacent to said printing drum;

on at least one of said side frames a first sliding support on which the ink roller is mounted and a second sliding support on which the plate-holding roller is mounted;

at least one linear guide member supported on the side frame for guiding movements of said first and second sliding supports in directions parallel to an imaginary line (L) which perpendicularly intersects the axes of the ink and plate-holding rollers; and actuating means configured and arranged for moving the first and second sliding supports between rest positions, in which sleeves can be axially inserted or removed from the ink and plate-holding rollers respectively, and work positions in which the plate-holding roller (6) is in contact with said web of material to be printed supported by the printing drum and the ink roller is in contact with the plate-holding roller, said actuating means comprising:

first upper and lower worm screws arranged parallel to said imaginary line (L) above and below the axes of the ink and plate-holding rollers respectively, respective first nuts joined to the first sliding support and coupled to said first upper and lower worm screws, and first actuating means for actuating the first upper and lower worm screws in unison; and second upper and lower worm screws arranged parallel to said imaginary line (L) above and below the axes of the ink and plate-holding rollers, respectively, respective second nuts joined to the second sliding support and coupled to said second upper and lower worm screws, and second actuating means for actuating the second upper and lower worm screws in unison.

2. A printing machine according to claim 1, wherein the first and second upper worm screws are separated from the first and second lower worm screws, respectively, by sufficient distances in order to allow the passage therebetween of said sleeves of the ink and plate-holding rollers, respectively, in their axial directions through at least one opening formed in the side frame.

3. A printing machine according to claim 2, further comprising at least two of said guide members in the form of at least one upper rail and at least one lower rail fixed to the side frame above and below the axes of the ink and plate-holding rollers respectively, and first upper and lower runners and second upper and lower runners joined to the first and second sliding supports, respectively, and coupled to said upper and lower rails.

4. A printing machine according to claim 3, wherein the upper rail is separated from the lower rail by a sufficient distance in order to allow the passage between both of said sleeves of the ink and plate-holding rollers, respectively, in their axial directions through said opening formed in the side frame.

5. A printing machine according to claim 4, wherein the first and second upper worm screws and/or the first and second lower worm screws are located further from the imaginary line (L) than the upper rail and/or the lower rail, respectively.

6. A printing machine according to claim 4, wherein the first and second upper worm screws (14, 21) and/or the first and second lower worm screws are located closer to the imaginary line (L) than the upper rail and/or the lower rail, respectively.

7. A printing machine according to claim 4, wherein the axes of the first and second upper worm screws and a central line of the upper rail are comprised in one and the same imaginary plane parallel to the axes of the ink and plate-holding rollers, and the axes of the first and second lower worm screws and a central line of the lower rail are comprised in one and the same imaginary plane parallel to the axes of the ink and plate-holding rollers.

8. A printing machine according to claim 4, wherein the axes of the first upper and lower worm screws and the axes of the second upper and lower worm screws are comprised in an imaginary plane perpendicular to the axes of the ink and plate-holding rollers.

9. A printing machine according to claim 3, wherein the axes of the first upper and lower worm screws and the axes of the second upper and lower worm screws are comprised in an imaginary plane perpendicular to the axes of the ink and plate-holding rollers.

10. A printing machine according to claim 2, wherein the axes of the first upper and lower worm screws and the axes of the second upper and lower worm screws are comprised in an imaginary plane perpendicular to the axes of the ink and plate-holding rollers.

11. A printing machine according claim 1, wherein the first and second upper worm screws are mutually aligned and the first and second lower worm screws are mutually aligned.

12. A printing machine according to claim 1, wherein the axes of the first upper and lower worm screws and the axes of the second upper and lower worm screws are comprised in an imaginary plane perpendicular to the axes of the ink and plate-holding rollers.

13. A printing machine according to claim 1, wherein said actuating means comprise a first electric motor supported on the side frame and connected to the first upper and lower worm screws by transmission means, a second electric motor supported on the side frame and connected to the second upper and lower worm screws by transmission means.

14. A printing machine according to claim 1, wherein the first upper and lower worm screws are at different distances from the imaginary line (L) and the second upper and lower worm screws are at different distances from the imaginary line (L).

15. A printing machine according to claim 1, wherein the first upper and lower worm screws are equidistant from the imaginary line (L) and the second upper and lower worm screws are equidistant from the imaginary line (L).

* * * * *